US006047833A

United States Patent [19]

Salomon

[11] Patent Number: 6,047,833

[45] Date of Patent: Apr. 11, 2000

[54] DISPLAY CASE WITH RETAINER FOR FIGURINE

[75] Inventor: Mark Salomon, New Rochelle, N.Y.

[73] Assignee: K & R Spraycraft, New Rochelle, N.Y.

[21] Appl. No.: 09/168,286

[22] Filed: Oct. 8, 1998

[51] Int. Cl.[7] ..... B65D 5/50

[52] U.S. Cl. ..... 206/765; 206/756; 206/486; 206/315.1; 206/769; 232/5

[58] Field of Search ..... 206/775, 477, 206/486, 776, 781, 756, 765, 769, 515, 518; 248/223.41, 298.1, 346.01, 346.03

[56] References Cited

U.S. PATENT DOCUMENTS

| | | | |
|---|---|---|---|
| 1,236,677 | 8/1917 | Coventry | 206/486 |
| 1,679,468 | 8/1928 | Garniss | 206/756 |
| 2,336,185 | 3/1943 | Moran | 248/346.01 |
| 3,358,819 | 12/1967 | Johnson . | |
| 3,406,816 | 10/1968 | Green et al. . | |
| 3,881,598 | 5/1975 | Schwimmer . | |
| 3,881,674 | 5/1975 | Greene, III . | |
| 4,204,598 | 5/1980 | Adams . | |
| 4,552,264 | 11/1985 | Quarrell et al. | 206/776 |
| 4,878,640 | 11/1989 | Fricker et al. . | |
| 5,383,558 | 1/1995 | Wilkinson et al. . | |
| 5,871,092 | 2/1999 | Rogers et al. | 206/769 |

OTHER PUBLICATIONS two photographs of "Crystal de Lites" container. No date avail.

*Primary Examiner*—Paul T. Sewell
*Assistant Examiner*—Troy Arnold, III
*Attorney, Agent, or Firm*—Hoffman, Wasson & Gitler, PC

[57] ABSTRACT

A display package has a base and transparent cover. The base has a flat surface with a retainer. The retainer receives and retains the base of a figurine. The display package allows for the attractive and secure way to display figurines at the point of purchase or by the ultimate purchaser.

2 Claims, 5 Drawing Sheets

DISPLAY CASE WITH RETAINER FOR FIGURINE

BACKGROUND OF THE INVENTION

Many people collect figurines as a hobby. These figurines are made of glass, crystal, pewter or other material. Often, the figurines are provided with a circular or rectangular base that support the figurine in a stable manner. Figurines are often displayed on shelves and mantels as part of home decoration.

Collectors of such figurines need a way to display these figurines in a way that protects the figurines but does not detract from their esthetic value.

Besides collectors, venders who sell these figurines need a manner of displaying these figurines at a point of purchase which allows the consumer to view the figurine in an attractive setting. The display package has to be inexpensive so that the consumer may be able to purchase the displayed package along with the figurine. The package should be small in length and weight and, while allowing viewing of the figurine, not detract from its esthetic function.

It is an object of the invention to provide a display case for figurines.

It is another object of the invention to provide a display case which has a container for securing a figurine.

It is still another object of the invention to provide a container for a figurine which has means to lock the figurine base in place.

It is yet another object of the invention to provide a display package which has cover which engages a base.

It is still another object of the invention to provide a display case which has a transparent cover.

SUMMARY OF THE INVENTION

The display case essentially consists of a base and cover. The base has a top surface and a depending skirt. On the top surface, a retainer is positioned to receive a base from a figurine. The retainer can receive either a circular or rectangular base and positively secure the figurine. The base has a planar surface and a depending skirt. The depending skirt creates an upwardly open channel to receive the bottom of the cover.

The cover is preferably transparent to allow easy viewing of the figurine. This enables a potential consumer or, after purchase, an admirer of the figurine to be able to view the figurine without having to open the package. The bottom edge of the transparent cover is received into the channel formed in the base. This arrangement allows the cover to be held onto the base and complete the package. The cover is easily removed if one wishes to gain access to the figurine. This can be done if one wants to remove the figurine or place a different figurine into the display case.

BRIEF DESCRIPTION OF THE DRAWINGS

The invention will be described with reference to the following drawings.

DETAILED DESCRIPTION OF THE INVENTION

Figure 1:
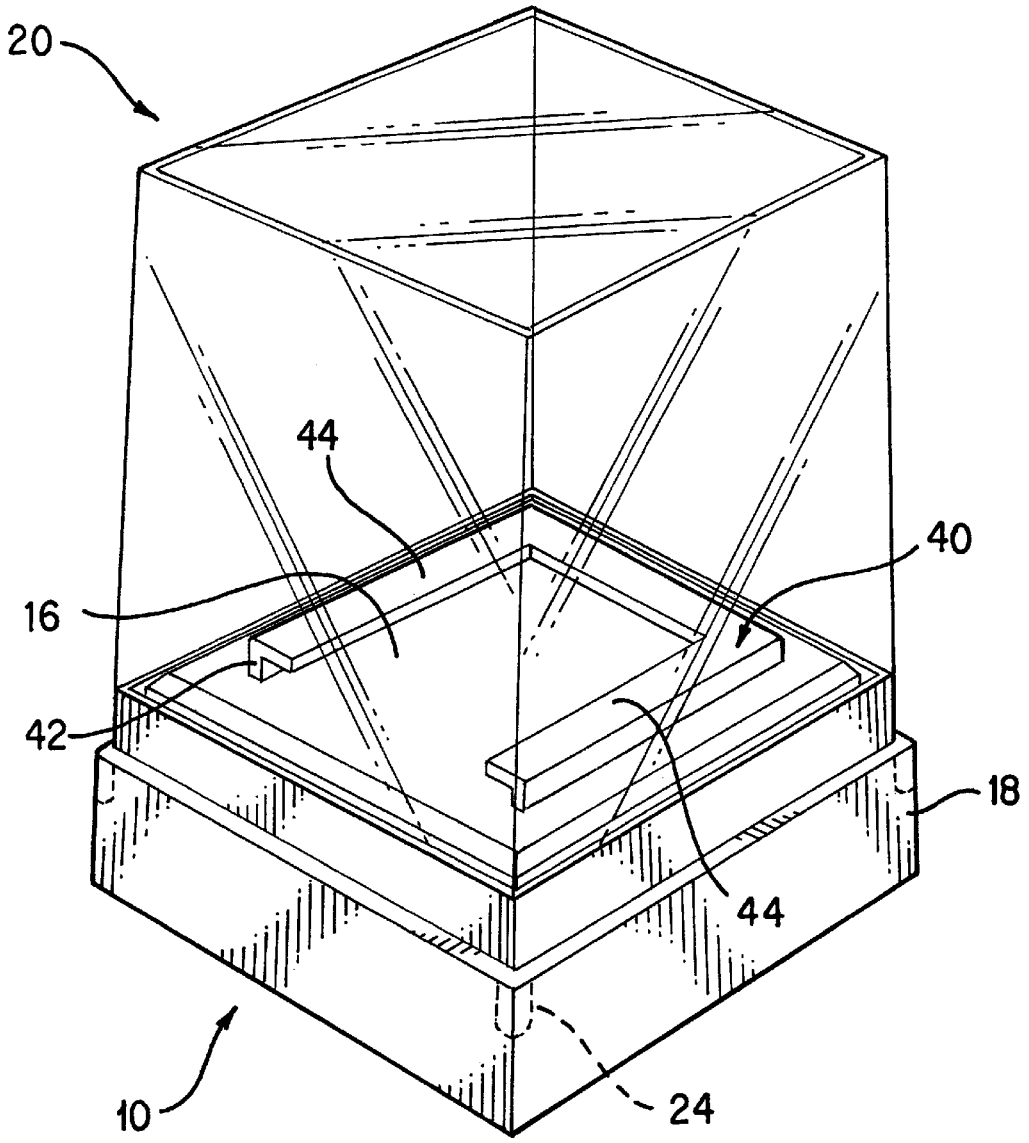
FIG. 1 is a perspective view of the display package.

As can be seen in FIG. 1, the display case has a base 10 and a cover 20. The base 10 has a top surface 16 and a depending skirt 18. The depending skirt has a stepped appearance as will be described later. On the top surface 16 is the retainer 40. The retainer 40 comprises an upwardly extending wall 42 and an inwardly extending wall 44. The cover 20 is preferably made of transparent plastic and has a cross-section that is complimentary in shape to the perimeter of the base 10.

Figure 2:
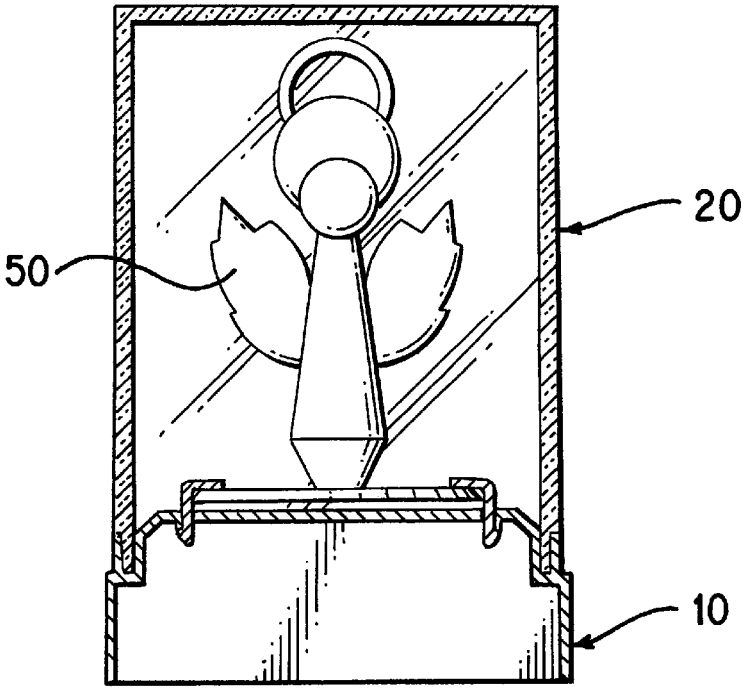
FIG. 2 is a cross-section of the package containing a figurine.
Figure 3:
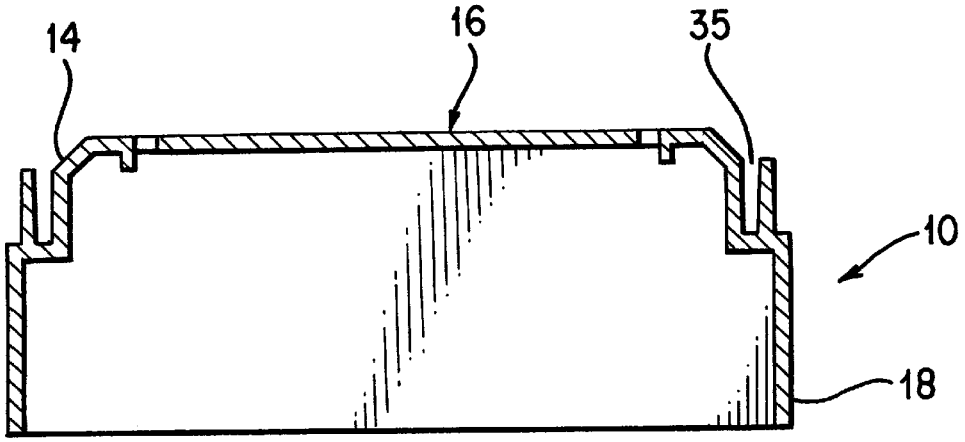
FIG. 3 is a cross-sectional view of the base.

FIG. 2 shows a cross-section view of a display container having a figurine 50. Referring now to FIG. 3, a cross-section of the base alone is shown. The base has the top surface 16 and the depending skirt 18. The depending skirt 18 creates an upwardly opening channel 35.

Figure 4:
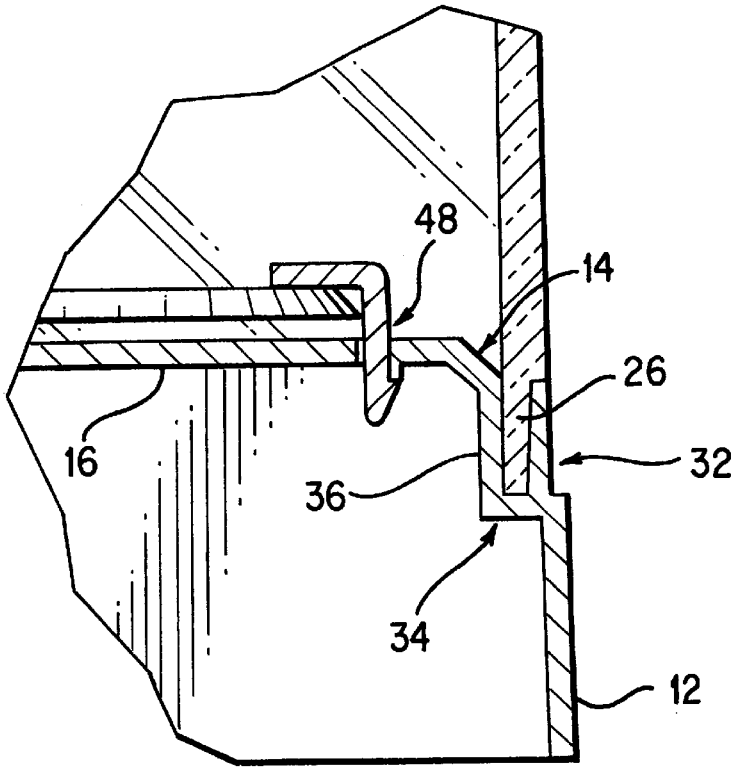
FIG. 4 is a detailed view of the base cover connection.

Details of the base and how it engages the cover can be seen in FIG. 4. As is shown, the depending skirt 18 is made of a bottom wall 12 and an outer channel wall 32 extending upwardly and slightly offset from the bottom wall 12. Extending from the outer channel wall 32 is the bottom channel wall 34. An inner channel wall 36 extends upwardly from the inner-most end of the bottom channel wall 34. Together, the outer channel wall 32, the bottom channel wall 34, and the inner channel wall 36 cooperate to form the channel 35. The channel 35 opens upwardly and tapers from its widest point at the top of the channel to the bottom of the channel.

As can be seen from the detailed view of FIG. 4, the cover creates a flush surface with the outer surface of the outer channel wall 32. A mentioned previously, the bottom wall 12 is offset from the outer channel wall 32. This allows the cover 12 to nest within the bottom wall 12 of a similar container. In this manner, several display cases can be stacked one on the other. The corners of the bottom wall can be provided with stops 24. The stops 24 are circular in cross section and shown in phantom in FIG. 1. The stops 24 serve to limit the nesting of similar containers as the upper surface of the cover will engage the bottom of the stops. In this manner, the stacked containers will not be stuck together.

Extending upwardly and inwardly from the top of the inner channel wall 36 is a rim 14. The rim 14, extending along all edges of the base, creates a beveled surface. At the inner edge of the beveled rim is the planar top surface 16. The planar top surface has apertures to receive the locks 48 extending from the retainer 40.

Figure 5:
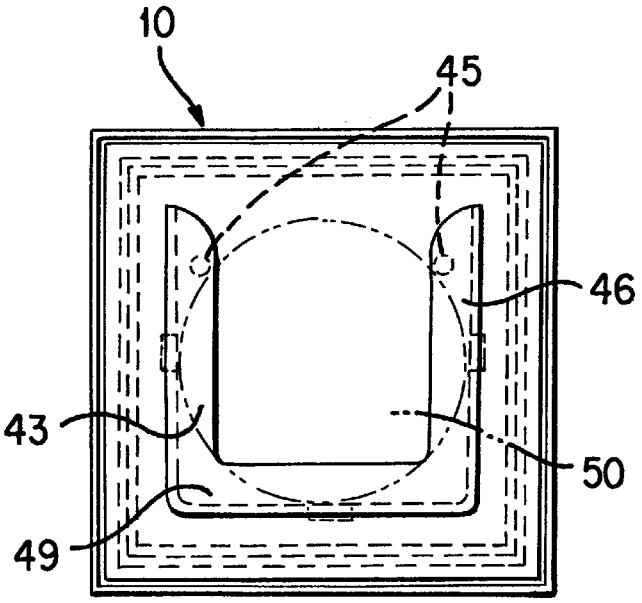
FIG. 5 is a top view of the base.

Turning now to FIG. 5, the interaction of the retainer 40 with the base of a figurine 50 can be seen in the top view of the base. The top surfaces of the channel walls are seen in dotted lines. Seen in this view are the detents 45 which are protrusions extending downwardly from the lower surface of the left 43 and right 46 arms of the retainer 40. When the base of the figurine is inserted into a retainer, the edge inserted first engages the protrusions and pushes them upwards. The base is allowed to pass the detents 45 because the inwardly extending wall 44 is able to flex upwards enough to provide clearance for the base of the figurine 50. After the base 50 has passed the detents 45, the detents no long impinge along the base, and the inwardly extending wall 44 returns to its pre-stressed condition. The detents 45 now present an interference for the removal of the figurine.

The figurine can be removed with some effort by the user, as gentle pressure will allow the detents to move upwardly with the inwardly extending wall to allow the figurine to be removed. But without pressure being applied by user, the detents served to prevent the base from sliding forwardly out of the retainer.

Figure 6:
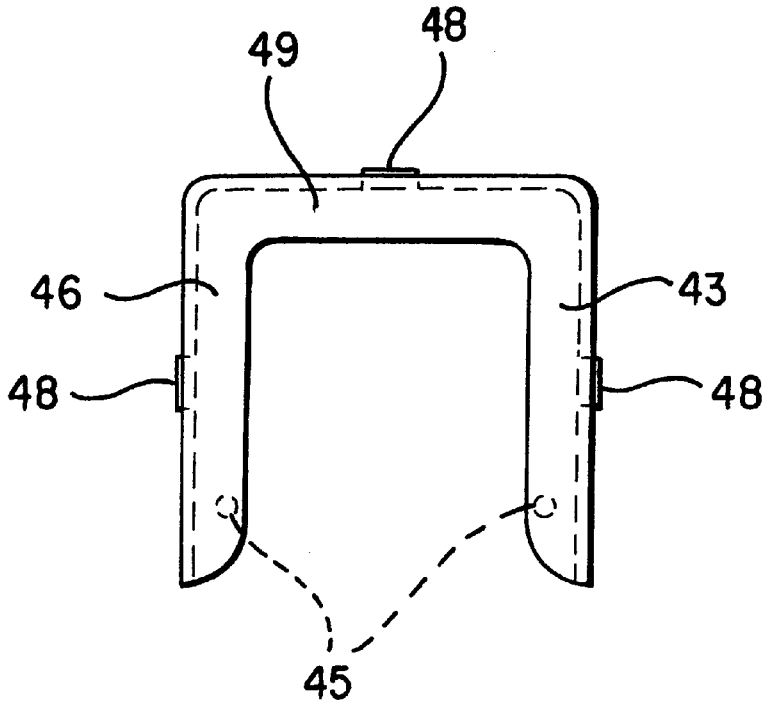
FIG. 6 is a view of the retainer.
Figure 7:
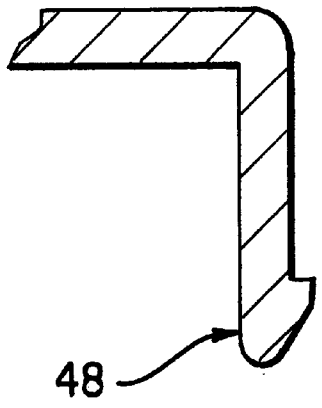
FIG. 7 is a detailed view of the retainer lock.

The retainer 40 is shown in detail in FIG. 6. As can be seen, the retainer is made of a left arm 43, a right arm 46, and a rear section 49. The detents 45 are located towards the front of the left and right arm. The front edges of the left and right arm can be rounded to both guide the base into the retainer and also present a aesthetic appearance. Each section of the retainer 43,46,49 is provided with a lock 48. The lock 48 is a depending piece having an enlarged beveled head. The lock 48 is clearly seen in detail in FIG. 7. The locks 48 engage apertures in the top surface 16. In this way, the locks 48 secure the retainer to the base.

Figure 8:
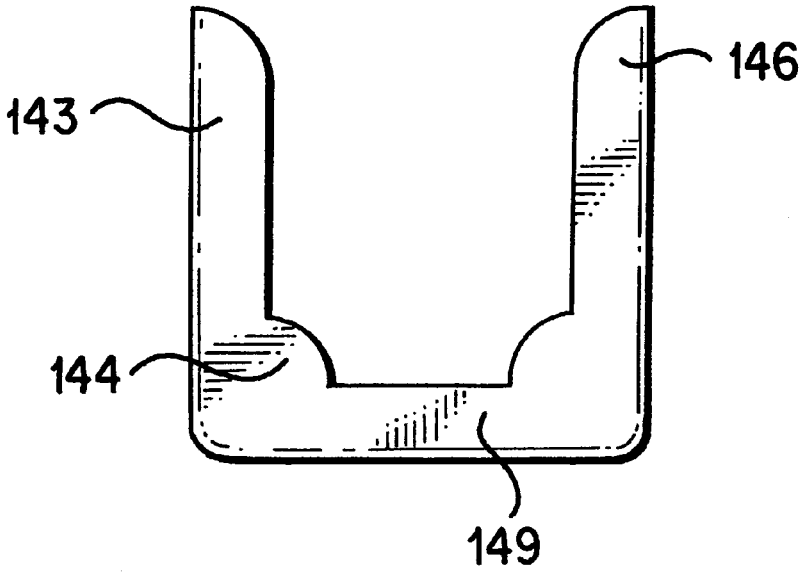
FIG. 8 is a top view of a second embodiment of the retainer.
Figure 9:
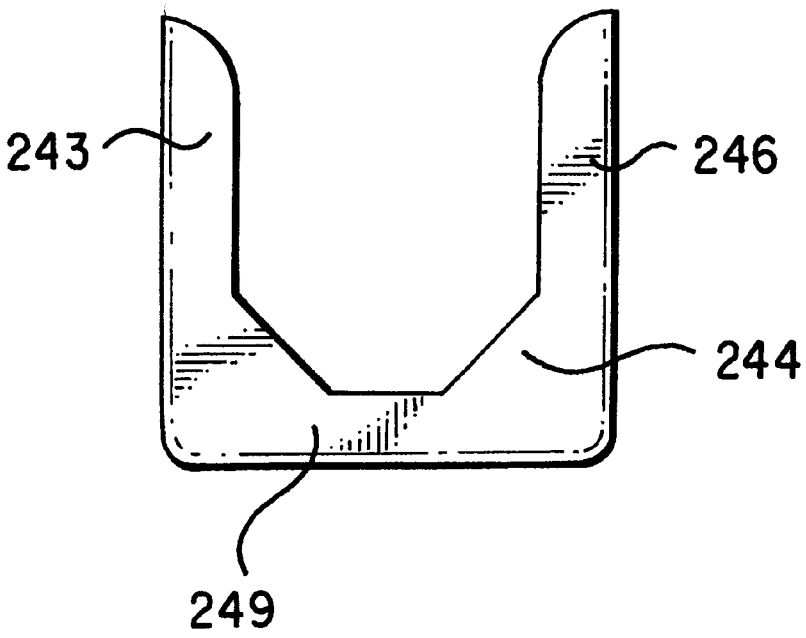
FIG. 9 is a top view of a third embodiment of the retainer.

It has been found that the upward flexing of the inwardly extending wall 44 that occurs when a figurine is inserted can lead to the locks on the retainer being pulled from the aperture in the base. The addition of material at the corner of the left and right arms 43,46, with the rear section 49 prevents this problem. Shown in FIG. 8 is an embodiment of the retainer where this extra material is in the form of a quarter circle 144. The quarter circle is placed at the corner of the arms 143,146 with the rear section 149 and provides enough stiffness to the left and right arms that force applied from the figurine being inserted does not cause the retainer to become separated from the planar top surface 16. Shown in FIG. 9 is another embodiment where the extra material is in the form of a triangle 244. The two corners are cut short as the material bridges the space where the left and right arms 243,246 meet the rear section 249.

The combination of the base, the base 10, cover 20, and retainer 40 combine with one another to create a display case that is visually pleasing, securely retains a figurine having a base and allows for the figurine to viewed while still in the package. The container is light weight and easy to manufacture. It can be used by both retailers and the consumers in order to display the figurines for others to see.

While the invention has been described with reference to a preferred embodiment, certain modifications and variations would be apparent to one of ordinary skilled in the art. The details of the disclosed embodiment are not meant to be limiting in any way.

We claim:

1. A display package comprising;

a base having a top surface and a depending skirt;

a cover engaging the base;

a retainer on the base top surface, the retainer having a left section and a right section, each section having a front edge and a rear edge;

further comprising an upwardly open channel on the base for receiving the bottom of the cover;

wherein the bottom of the cover has a reduced thickness area, the reduced thickness area being tapered.

2. A display package comprising;

a base having a top surface and a depending skirt;

a cover engaging the base;

a retainer on the base top surface, the retainer having a left section and a right section, each section having a front edge and a rear edge;

the left and right section each comprise an upwardly extending wall and an inwardly extending wall; and protrusion extending from the lower surface of the inwardly extending wall of the left and right sections.

* * * * *